US005667338A

United States Patent [19]

Logan

[11] Patent Number: 5,667,338

[45] Date of Patent: Sep. 16, 1997

[54] SPILL CONTAINMENT SYSTEM

[76] Inventor: Ronald Logan, Apt. #7, 270 Parkside Drive, Fredericton, New Brunswick, E3B 5V7, Canada

[21] Appl. No.: 515,673

[22] Filed: Aug. 16, 1995

[30] Foreign Application Priority Data

Aug. 25, 1994 [CA] Canada ..... 2130890

[51] Int. Cl.[6] ..... E02B 15/06

[52] U.S. Cl. ..... 405/66; 405/63; 405/68; 210/242.3; 210/923

[58] Field of Search ..... 405/60, 66, 67, 405/68, 69, 63, 65; 210/242.3

[56] References Cited

U.S. PATENT DOCUMENTS

| | | | |
|---|---|---|---|
| 3,118,412 | 1/1964 | Smith . | |
| 3,599,434 | 8/1971 | Missud | 405/68 X |
| 4,249,834 | 2/1981 | Bouvier . | |
| 4,559,137 | 12/1985 | Lundin . | |
| 4,960,347 | 10/1990 | Strange . | |
| 4,964,758 | 10/1990 | Pekelny . | |
| 4,998,845 | 3/1991 | Smith . | |
| 5,002,430 | 3/1991 | Smith . | |
| 5,003,908 | 4/1991 | Wilson . | |
| 5,004,372 | 4/1991 | Dickie et al. . | |
| 5,051,029 | 9/1991 | Ecker . | |
| 5,056,957 | 10/1991 | Wood, Jr. . | |
| 5,064,310 | 11/1991 | Sullivan . | |
| 5,066,164 | 11/1991 | Tomosy . | |
| 5,071,287 | 12/1991 | Wallace . | |
| 5,071,545 | 12/1991 | Ashtary . | |
| 5,120,159 | 6/1992 | Smith . | |
| 5,135,325 | 8/1992 | Eddy . | |
| 5,203,273 | 4/1993 | Sandlofer . | |
| 5,216,973 | 6/1993 | Gwinn . | |
| 5,217,611 | 6/1993 | Ayroldi . | |

*Primary Examiner*—Dennis L. Taylor

*Attorney, Agent, or Firm*—Zarley, McKee, Thomte, Voorhees & Sease

[57] ABSTRACT

A spill containment system for vessels comprises a curtain capable of extending continuously around the entire vessel and having a vertical dimension sufficient to extend from a height above the waterline to a depth below the waterline. The curtain is stored in canisters on or beneath the deck inboard from the hull or rail but capable of being deployed by articulated arms to a position outboard of the ship where the curtain can be deployed into the water to maintain and control a spill from the vessel.

8 Claims, 13 Drawing Sheets

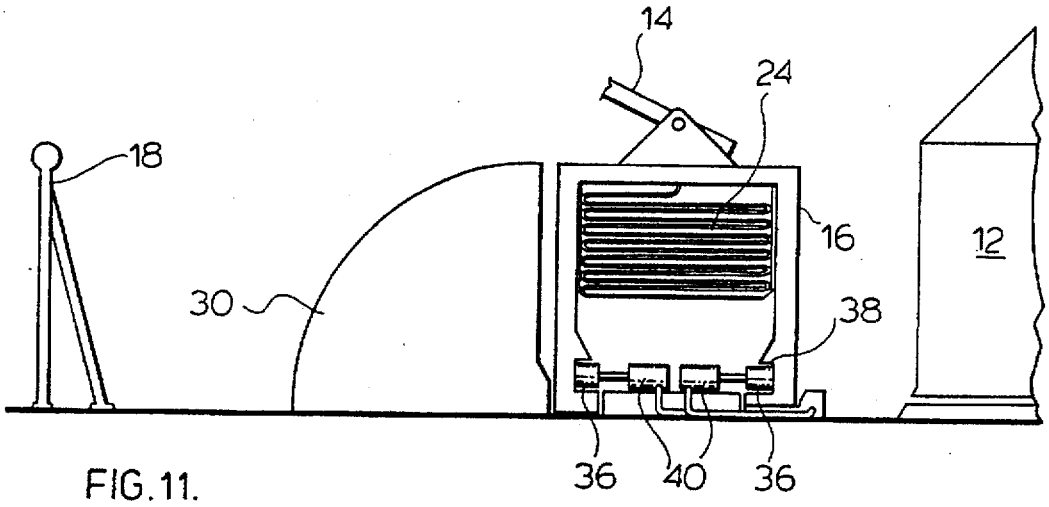
FIG.11.
FIG.12.
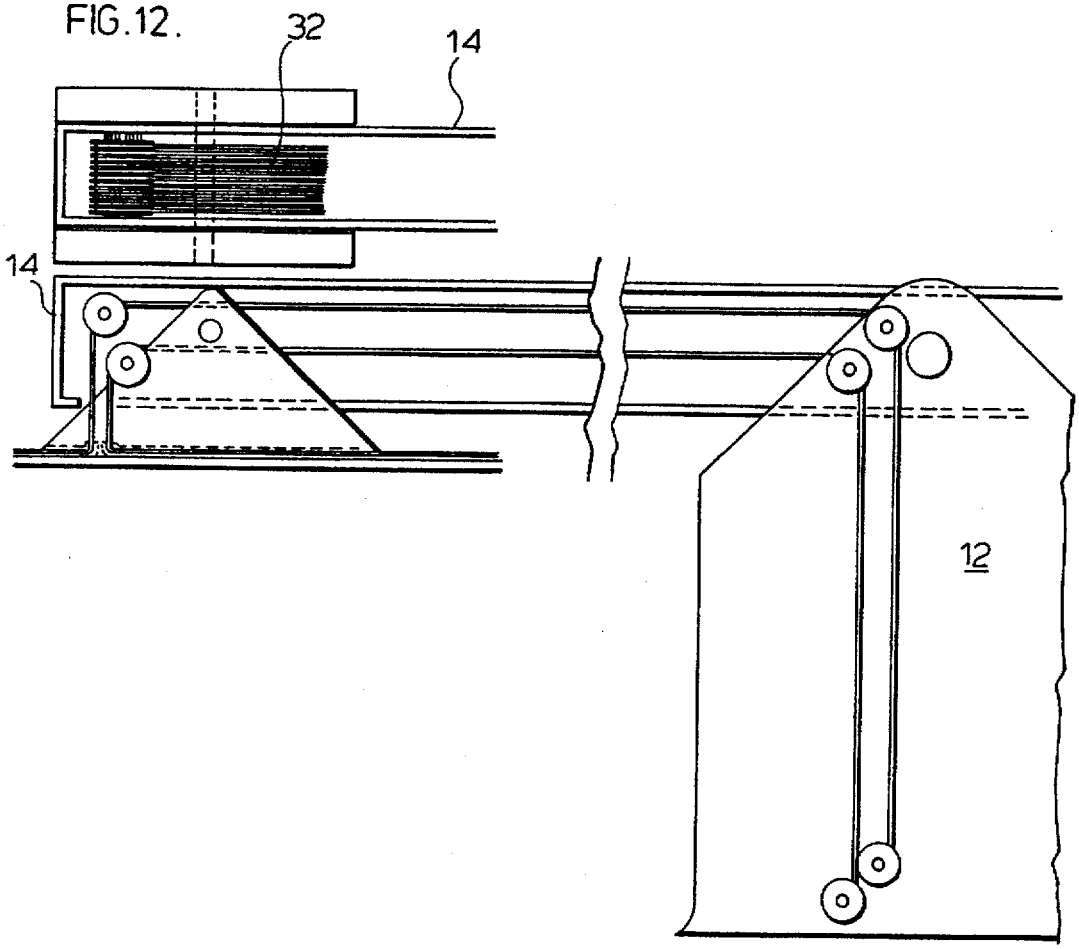

SPILL CONTAINMENT SYSTEM

This invention relates to improvements in the containment of environmentally toxic or contaminating spills. More particularly, it relates to improvements in containing the escape of environmentally hazardous material from vessels such as tanker, ships or barges into lakes, oceans, rivers, and shorelines.

Recent developments in the transportation of hazardous products, such as crude oil or other petroleum product by enormous tanker ships, has resulted in some well publicized disasters in which collisions or sinking or grounding of these vessels have resulted in enormous oil spills with accompanying damage to sea water, shorelines and vegetation and wild life. In addition to the damage to the environment, the cost of dealing with and cleaning up such spills has become costly from a legal and operational standpoint.

As a result, various attempts have been made to design and install equipment which will minimize the effects of these spills by containment. The earliest and most basic systems involved a boom containing an elongated flotation member with a downwardly depending curtain which would surround the spill (which in the case of oil is generally floating at or near the top of the water), and keep it from spreading laterally on the surface.

These primitive devices had serious limitations. First of all they were often located at some storage facility and had to be transported some distance to the scene of the spill. Secondly, they had to be deployed after the spill had somewhat enlarged. Thirdly, the boom systems were often quite inadequate under ocean conditions. Thus, the equipment was forced to deal with an oil spill which had already spread over a substantial area and was difficult to deal with on such a large scale.

Such booms were also often unmanageable in rough seas, and were not capable of containing oil seeping from the bottom of a tanker which had run aground.

The size of modern day oil tankers, and the value of their cargo, as well as the expense in dollars and damage to the environment, justify systems which are specifically designed for and installed on such vessels rather than multipurpose facilities established on shore.

Some devices have been designed for installation on tanker ships to deal with oil spills from the hull wherever the ship may be on the open ocean, in harbour, or at a pumping station.

However, many of these devices are designed merely to attempt to isolate the hole from which the oil is escaping, but in cases where ships receive extensive damage from grounding, these devices are inadequate. Other devices designed to wrap the hold in a membrane and are impossible to deploy when the ship is grounded. Some devices are variations of the original concept of a flotation boom with a depending curtain, but these are difficult to deploy even if they are available on the vessel.

Some attempts to solve these problems have resulted in designs for containment systems which are built on to the sides of ships so that they can be released to form a vertical curtain around the vessel extending into the water to stop the spread of the spill. These devices also have certain limitations. Some are mounted on the sides of the ship where they would be damaged and inoperable in the case of a collision. Others are deployed too close to the hull of the ship and do not provide sufficient space for the containment curtain to ride free of the hull of the vessel and to provide sufficient area and volume to contain the spill.

It is therefore the purpose of this invention to provide a contamination spill containment system capable of being installed on a ship or oil tanker and capable of deployment to form a containment curtain around the ship to isolate and prevent the spread of any spillage of oil or the like.

It is also the purpose of this invention to provide a system which may be mounted on deck or within the hull of the vessel so that it is not exposed to damage from collision or impact. It is also the purpose of this invention to provide a containment system which completely encircles the vessel so as to be effective even when the source of the leakage or spill is not accessible.

It is also the purpose of this invention to provide a containment wall of sufficient vertical height to prevent escape of the spilled material even in rough seas.

It is also the purpose of this invention to provide a system which can be deployed at a spaced distance from the hull so as to provide an adequate area of containment for the volume of material which may be spilled from the vessel, or may be moved close to the hull if desired.

It is also the purpose of this invention to provide a containment system which may be neatly and compactly stored ready for quick and efficient deployment, and may be subsequently retracted and returned to its stored position.

It is also the purpose of this invention to provide a system which can be located away from the rail or at a position on the deck where the facility will not be in the way of activities on deck.

It is also the purpose of this invention to provide a containment system in which the height of the barrier may be adjusted high enough to prevent leakage or spillage over the top of it, or low enough to permit fire fighters access to the containment area over the top of the barrier.

It is also the purpose of this invention to provide a system which may be protected from wave action when the vessel is low in the water.

These objects and other advantages are sought to be achieved by means of a spill containment system, in accordance with the present invention, which comprises a containment curtain capable of extending continuously around the vessel and having a vertical dimension capable of extending from a height above the waterline to a depth below the waterline, a series of canisters capable of receiving the containment curtain in folded configuration therein, cable guide means associated with said curtain capable of raising said curtain into a folded configuration or releasing said curtain to hang vertically, and a deployment mechanism having an articulated arm connected to said canisters and operable to move said canisters containing said folded curtain from a storage position inboard of the hull of the vessel to a deployed position outboard of the hull of the vessel.

The invention may be better understood by a description of one embodiment thereof with reference to the accompanying drawings in which:

FIG. 11 is a cross-sectional view of the containment system stored on deck;

FIG. 12 is a diagram of the cables by which the containment system is deployed or retracted;

FIGS. 1 to 8 show the system in general schematic illustrations.

Figure 1:
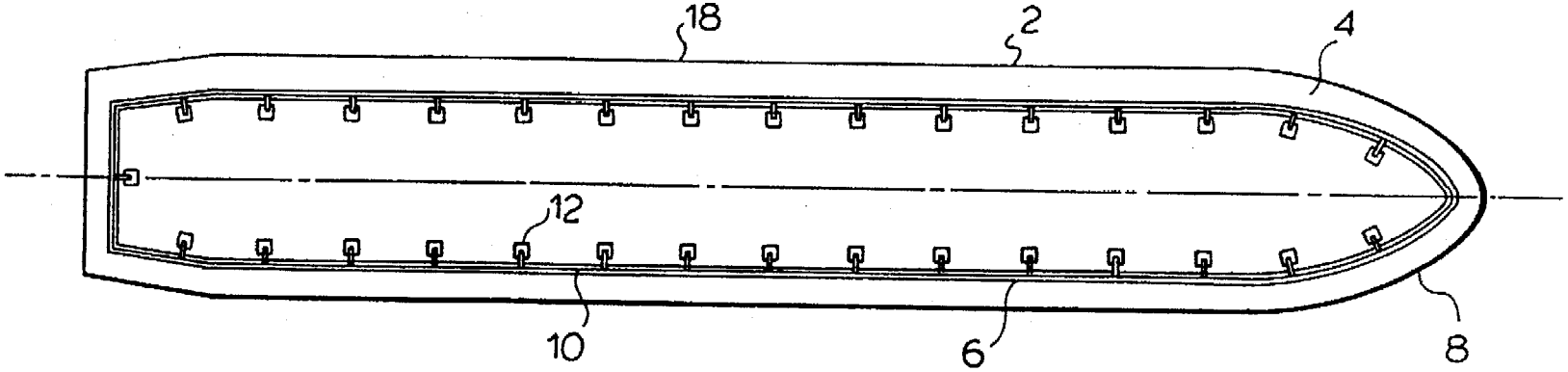
FIG. 1 is a plan view of a tanker ship equipped with a containment system of the present invention installed.

FIG. 1 illustrates a ship 2 designed to carry petroleum or other such commodities which are capable of escaping and damaging the environment. On the deck 4 is a spill containment system 6 located inboard from the hull 8 and running continuously around the ship near the rail 18.

The system features a continuous collapsed containment apparatus 10 and a series of deployment mechanisms 12.

Figure 2:
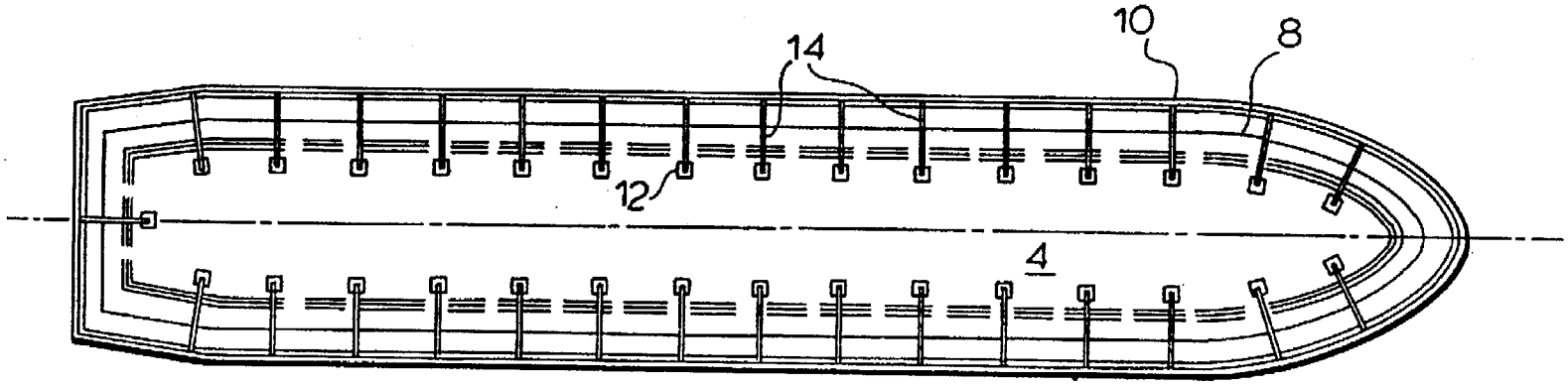
FIG. 2 is a plan view of the ship in FIG. 1 with the containment system deployed.

In FIG. 2 the containment apparatus 10 is shown removed from storage and deployed outboard of the hull 8 where it surrounds the ship. The deployment is effected by the deployment mechanism 12 using the articulated arms 14.

Figure 3:
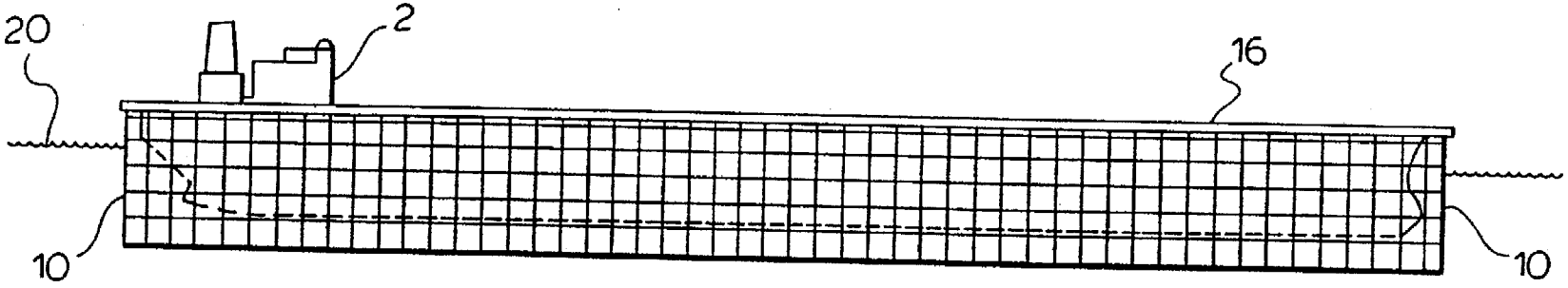
FIG. 3 is an elevation view of the ship in FIG. 2 with the containment curtain deployed.

In FIG. 3 the system is illustrated with the ship 2 completely surrounded by the containment apparatus 10 which hangs downward below the waterline 10, suspended from the canisters 16 which are supported by the arms 14 referred to above and shown in FIG. 2.

Figure 4:
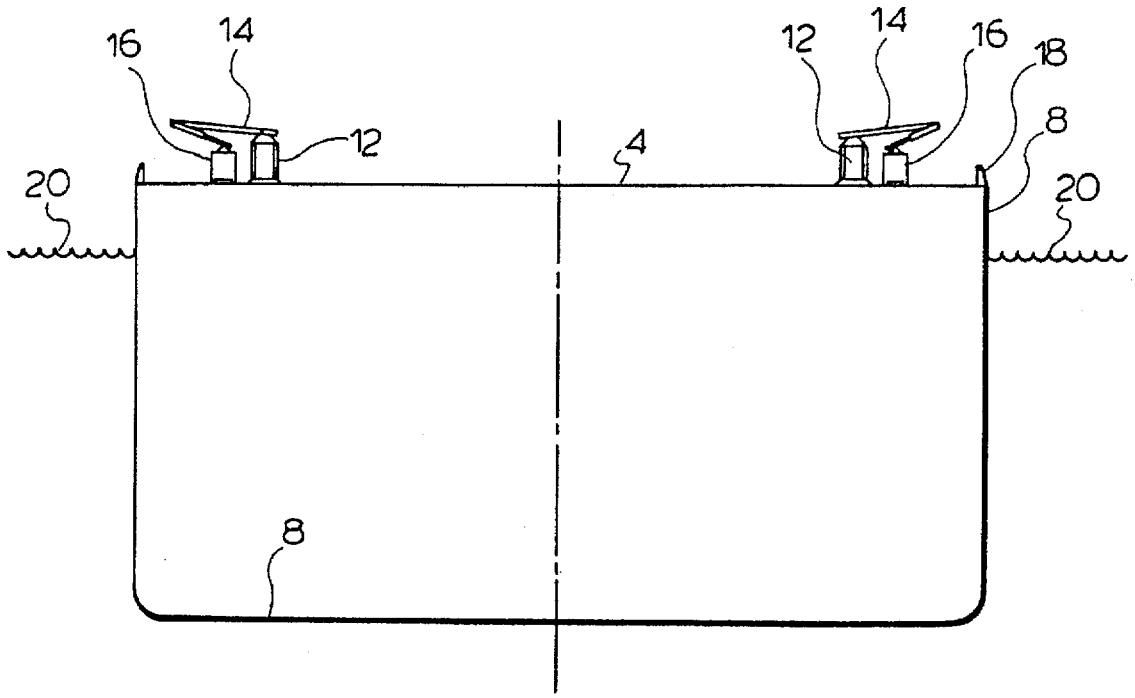
FIG. 4 is a cross-sectional view of the tanker in FIG. 1 showing the position of the system stored on deck.

FIG. 4 is a cross-sectional view of the system in which the deployment mechanism 12 and the articulated arm 14 are mounted on the deck inboard from the rail 18, and the hull 8 is mostly submerged below the waterline 20.

At the end of the articulated arm is the canister 16 in which the containment curtain 24 is collapsed and stored on decks when the system is not in use.

Figure 5:
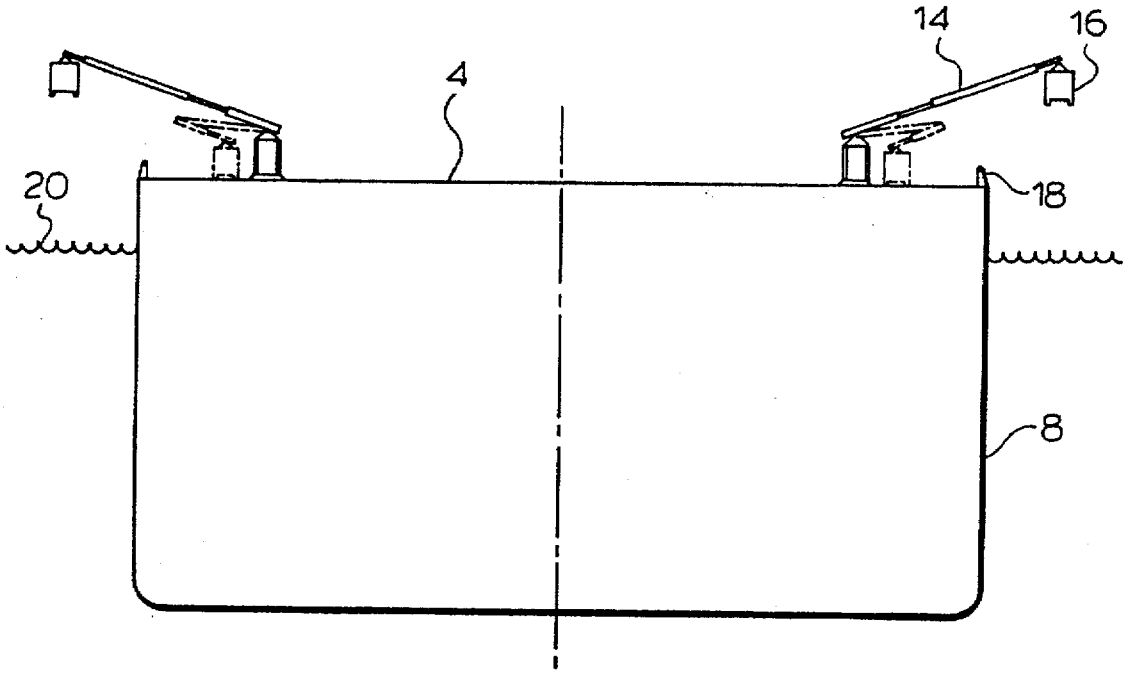
FIG. 5 is a cross section which shows the system of FIG. 4 partly deployed.

In FIG. 5 the system is partially deployed and the canister 16 is shown at the end of the articulated arm 14 raised above and outboard of the rail 18 in a position ready for deployment of the containment curtain.

Figure 6:
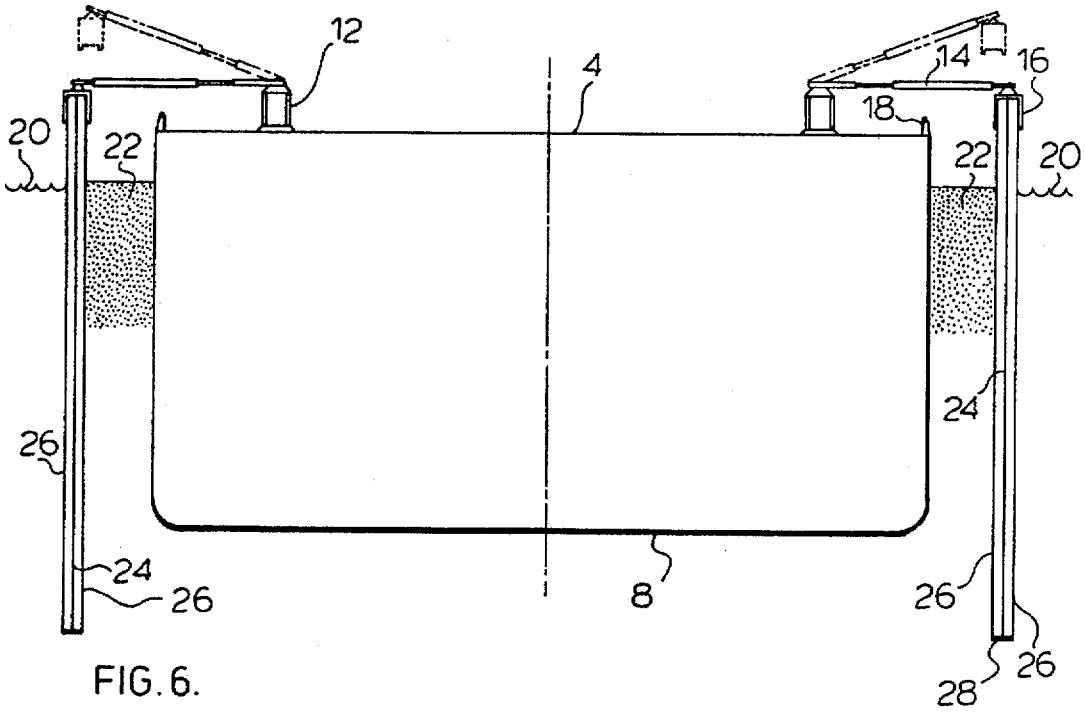
FIG. 6 is a cross section which illustrates the system of FIG. 4 fully deployed.

In FIG. 6 the partially deployed system is shown in dotted lines, and the fully deployed system is shown with the articulated arm 14 extending outwardly from the vessel supporting the canister 16 substantially above the waterline, and the containment curtain 24 which previously was folded within the canister 16 is hanging vertically into the water at a substantial depth so as to separate the spilled oil or other containment 22 from the rest of the ocean 20.

Also shown in FIG. 6 are cables 26 which serve to retract the containment curtain and control it laterally so that it folds into a configuration capable of entering the canister 16 for storage. Weights 28 may be used to help deploy the curtain and hold it vertical in the water.

Figure 7:
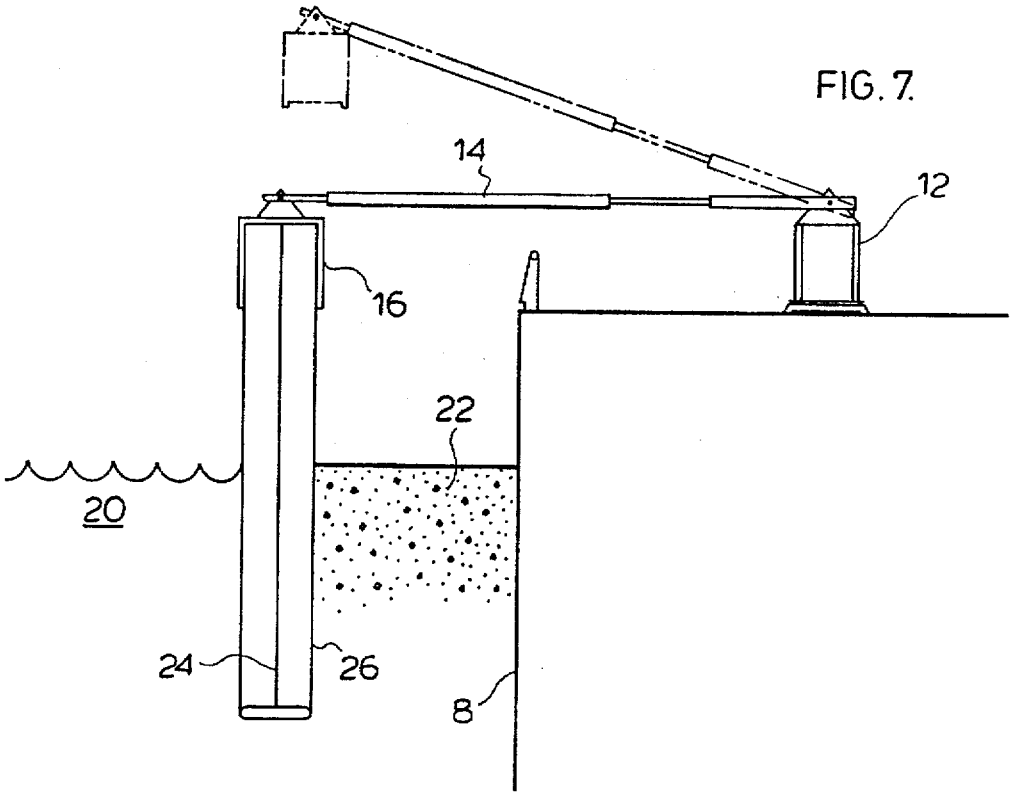
FIG. 7 is a more detailed cross-sectional view of the features of the system in the deployed configuration.

FIG. 7 shows the deployed containment system in greater detail with the partially deployed system shown in dotted lines.

Figure 8:
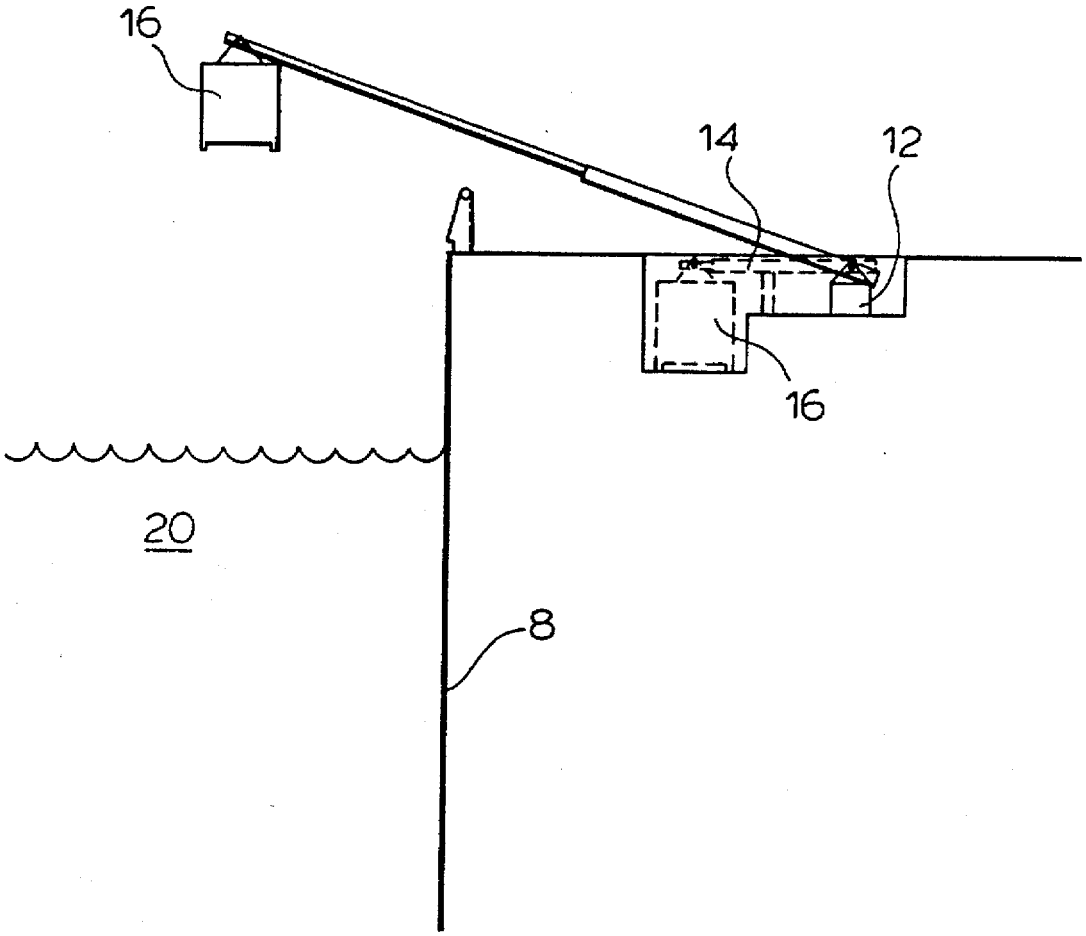
FIG. 8 is a cross-sectional view of an alternative design for the installation of the system.

FIG. 8 illustrates an alternative system in which the deployment mechanism 12, the canister 16, and the arm 14 are stored, when not in use, in a recess below deck so that they are sheltered from the arms and protected against damage.

FIGS. 9 to 16 show the construction and operation of the system shown in FIGS. 1 to 8.

Figure 9:
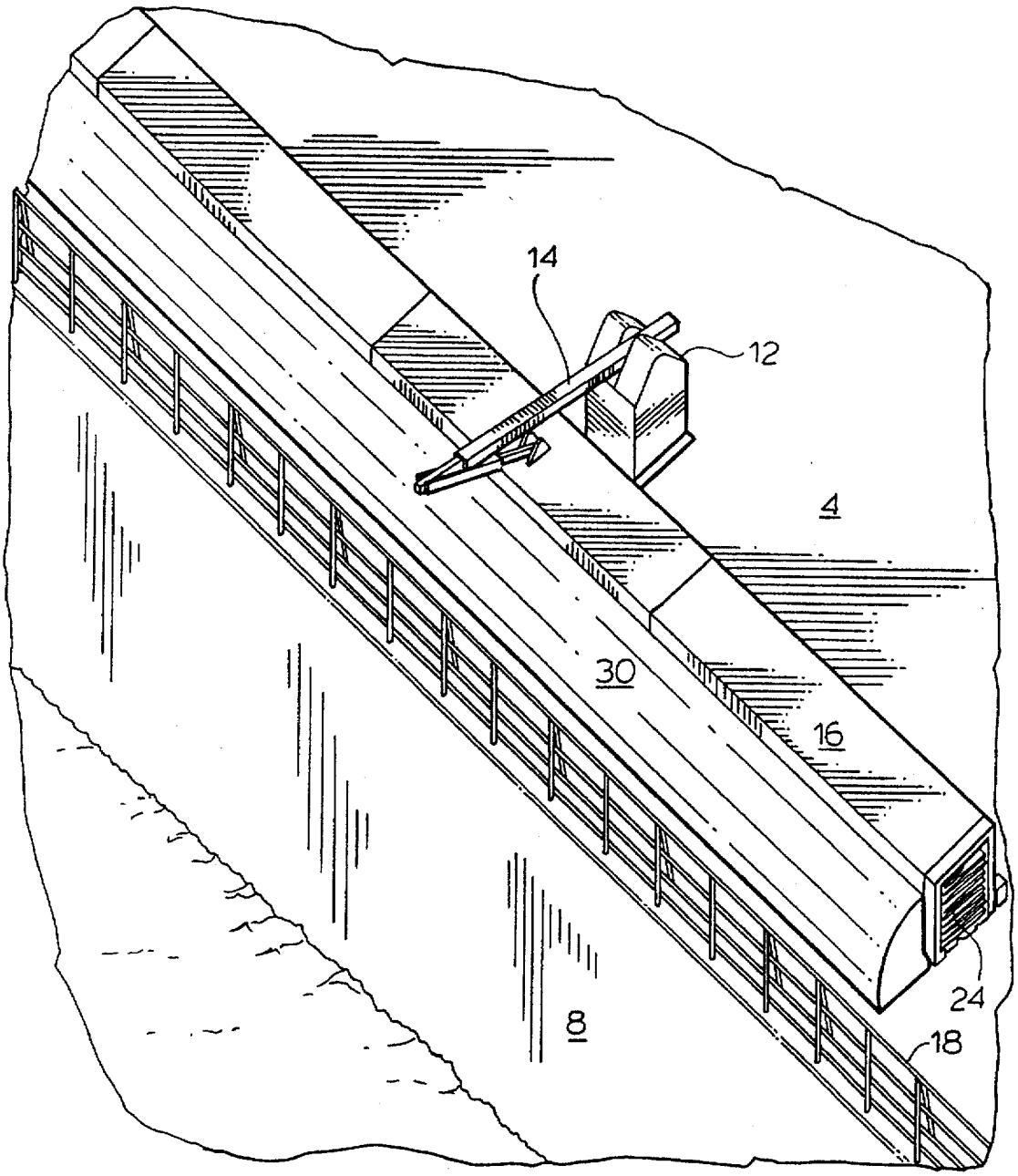
FIG. 9 is an isometric view of the system stored on deck.

FIG. 9 is an isometric illustration of the system schematically represented in FIGS. 1 to 8 and shows the hull 8 and rail 18 behind which are the canisters 16 which house the folded and stored containment curtain 24. One of the deployment mechanisms 12 and one of the articulated arms 14 are also illustrated.

In this view a further improvement is illustrated in the form of a wave barrier or deflector 30 mounted in front of the canisters to prevent damage to the system in high seas, especially when the vessel is riding low in the water.

Figure 10:
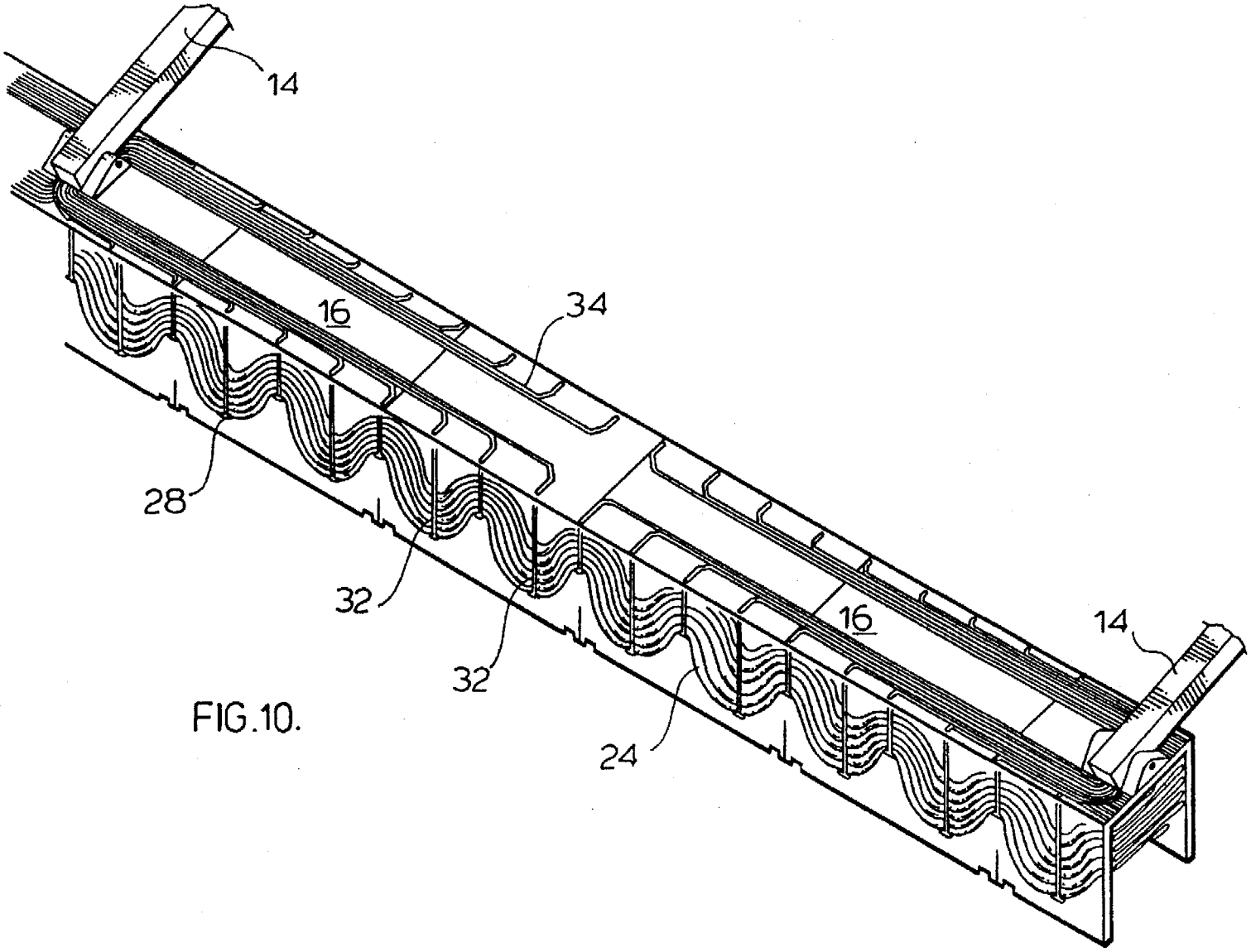
FIG. 10 is a cut-away view of the method of storage of the containment system.
Figure 13:
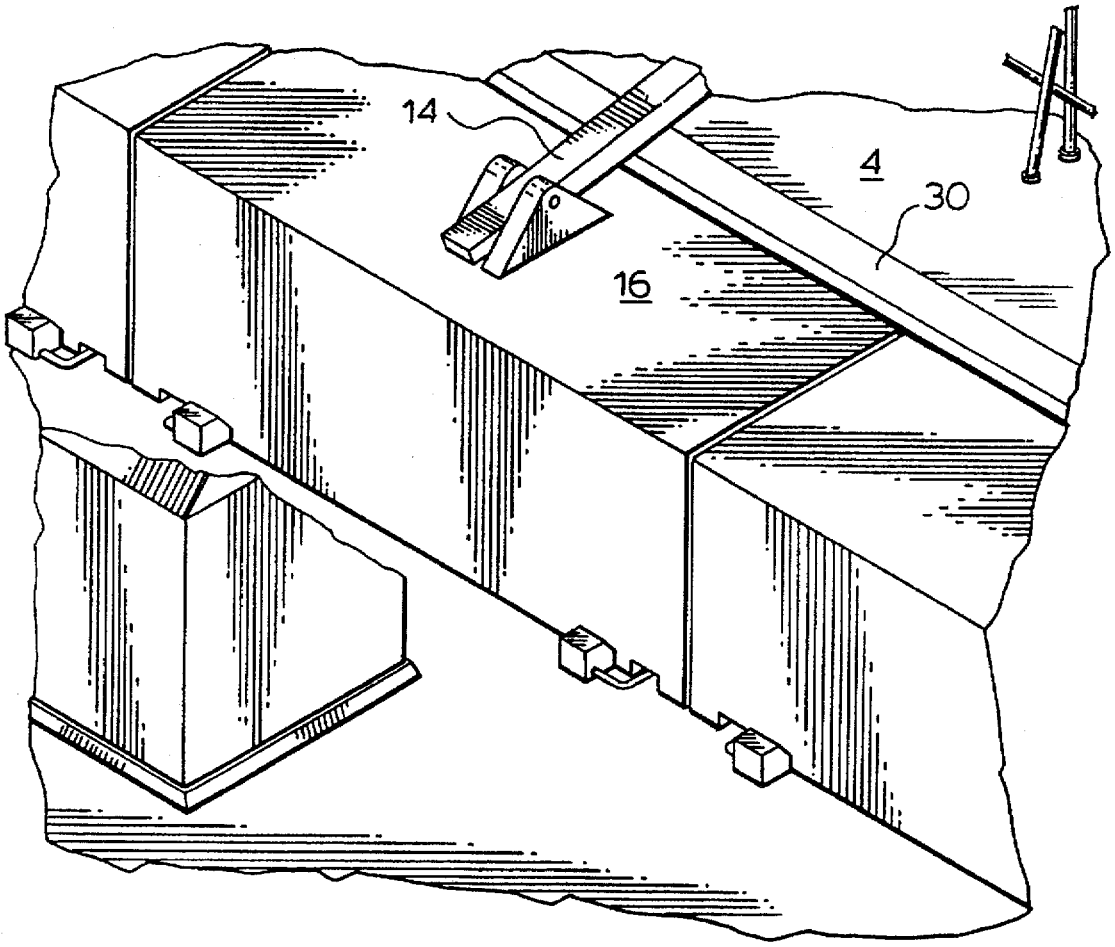
FIG. 13 is an isometric view of the canisters containing the containment system and drains.

In FIG. 10 the canister and storage system for the containment curtain is shown in greater detail with the articulated arms 14 connected to the canisters 16.

It should be realized that in order to be most effective the containment curtain should be continuous and uninterrupted both vertically and around the periphery of the vessel. Similarly, the canister 16 which houses and deploys the curtain must extend around the entire periphery. However, they are separate pieces, although they are connected together in a manner which will be described in greater detail later.

As seen in the cut-away exposed view of FIG. 10, the curtain 24 is folded up into the canister by means of the cables 32 which not only raise the curtain but contain them laterally in the shape illustrated prior to entry into the canister.

The cables 32 are led out or retracted through the guide system 34 which leads back to the arm 14 and the deployment mechanism 12 from which the cables are operated.

It should be realized that because the peripheral length of the curtain required to surround the vessel at a distance outboard of the hull is somewhat greater than the peripheral distance of the stored system around the deck inboard of the rail, the difference in those dimensions is accommodated by the undulating configuration of the curtain shown in FIG. 10.

FIG. 11 shows a cross-sectional view of the system illustrated in FIGS. 9 and 10 in which the curtain 24 is folded and retracted within the canister 16 connected to the arm 14. The wave deflector 30 is positioned in front of the canisters.

Furthermore, in order to maintain the canisters in proper position during stormy weather or heavy seas, a locking mechanism is provided in which a pin 36 is designed to engage a recess 38 when the system is not in use, and the pin can be retracted by the hydraulic piston 40 to release the canister when the system needs to be used.

FIG. 12 illustrates the cable guide system of the illustrated embodiment by which the cables 32, which extend to the bottom of the containment curtain, are led back through the guides 34 to the arm 14 and ultimately to the deployment mechanism 12 where they can be operated to let out or retract the curtain as needed.

As previously mentioned, in order to accommodate the required peripheral dimension of the curtain when deployed, it is necessary to store the curtain on deck in an undulating pattern as illustrated in FIG. 10. Conversely, the containers which are continuously aligned and adjacent when the system is stored on deck, are required to expand longitudinally when the system is deployed to the larger dimension outboard of the hull.

Figure 14:
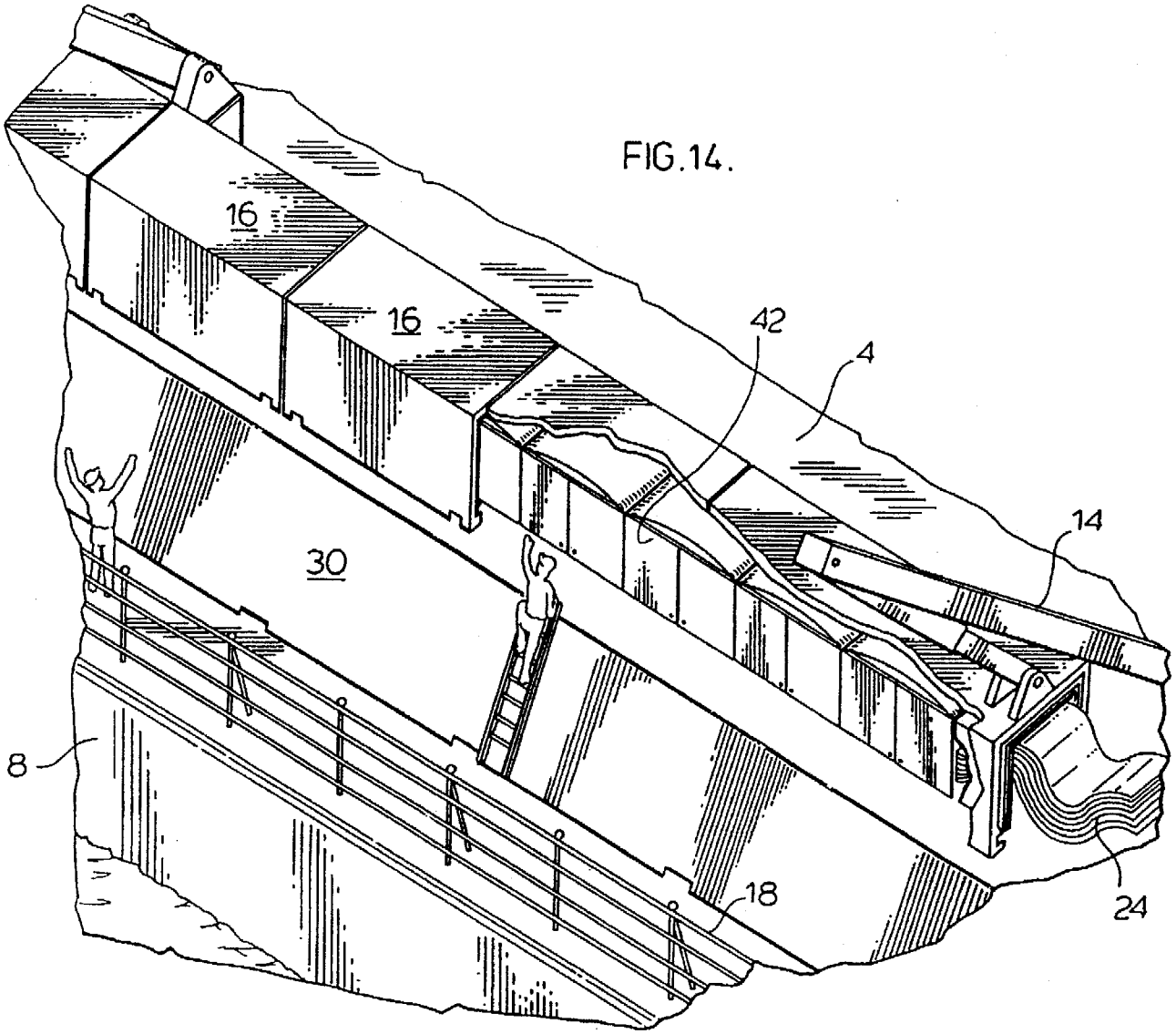
FIG. 14 is a cut-away view which illustrates the means by which the canisters and the containment apparatus is stored.

This is accomplished by means of the arrangement which is illustrated in the pictorial cut-away view illustrated in FIG. 14 in which adjacent canisters 16 are lifted above the wave deflector 30 by means of the articulated arms 14 but are not yet positioned outboard of the rail.

As previously illustrated in FIG. 10, the curtain is folded and foreshortened by an undulating pattern.

In the version illustrated in FIG. 14, an additional feature is provided in the form of a folding assembly 42 which assists in managing the curtain 24 and may also serve as a flotation device for the curtain.

Figure 15:
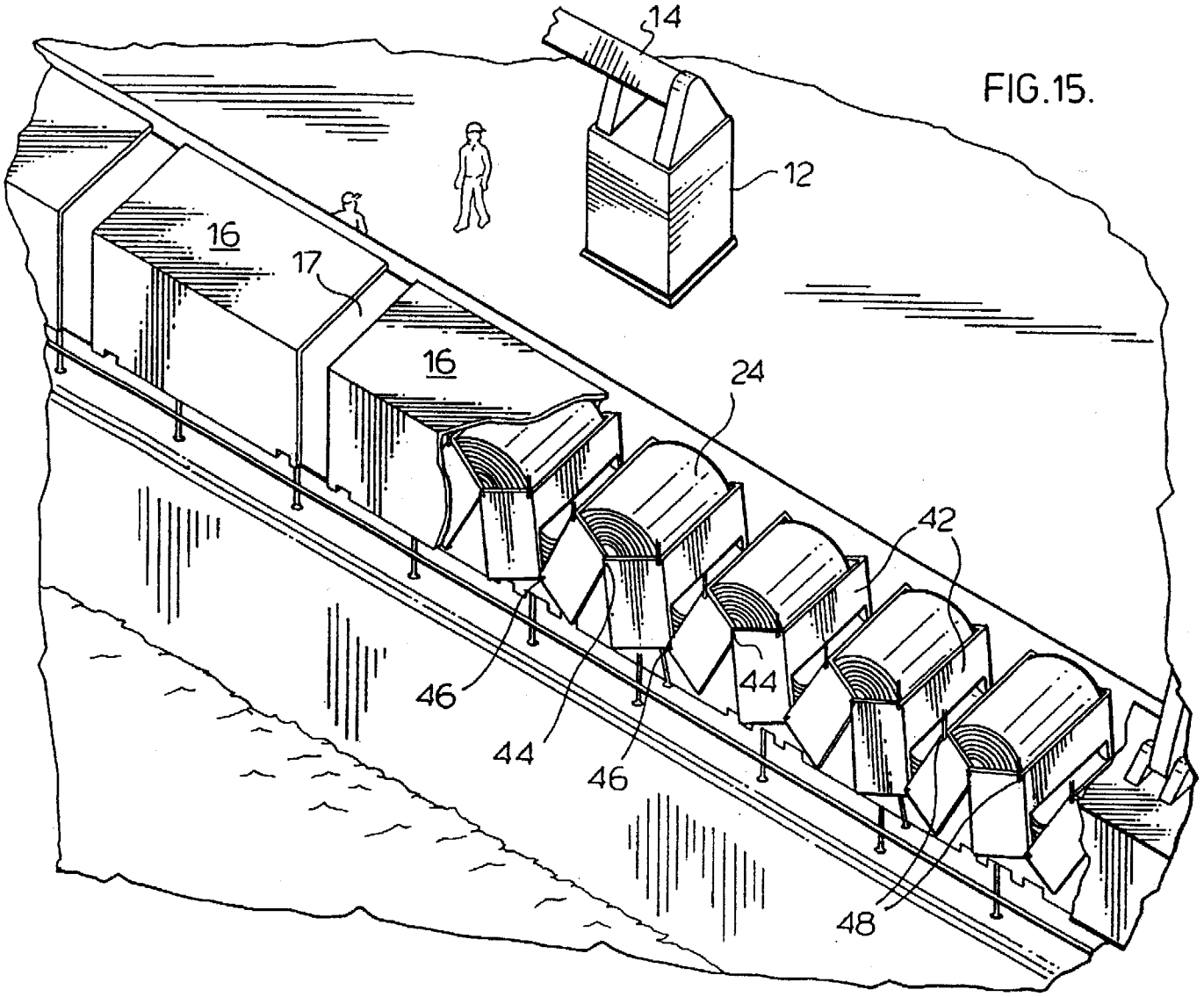
FIG. 15 illustrates the configuration as the apparatus is moved into position for deployment.

In FIG. 15 the canisters 16 are shown partially moved towards the outboard position and are therefore separated at 17 to provide the additional peripheral dimension. At the same time the undulations of the curtain 24 are beginning to be stretched longitudinally, and the folding assemblies 42 are expanding to accommodate this dimension. This is made possible by the folding assemblies being hinged at the corners 44 near the top and 46 near the bottom. The folding assemblies are controlled and lifted or lowered by means of cables at the upper corners 48 opposite the pivot points 44.

Figure 16:
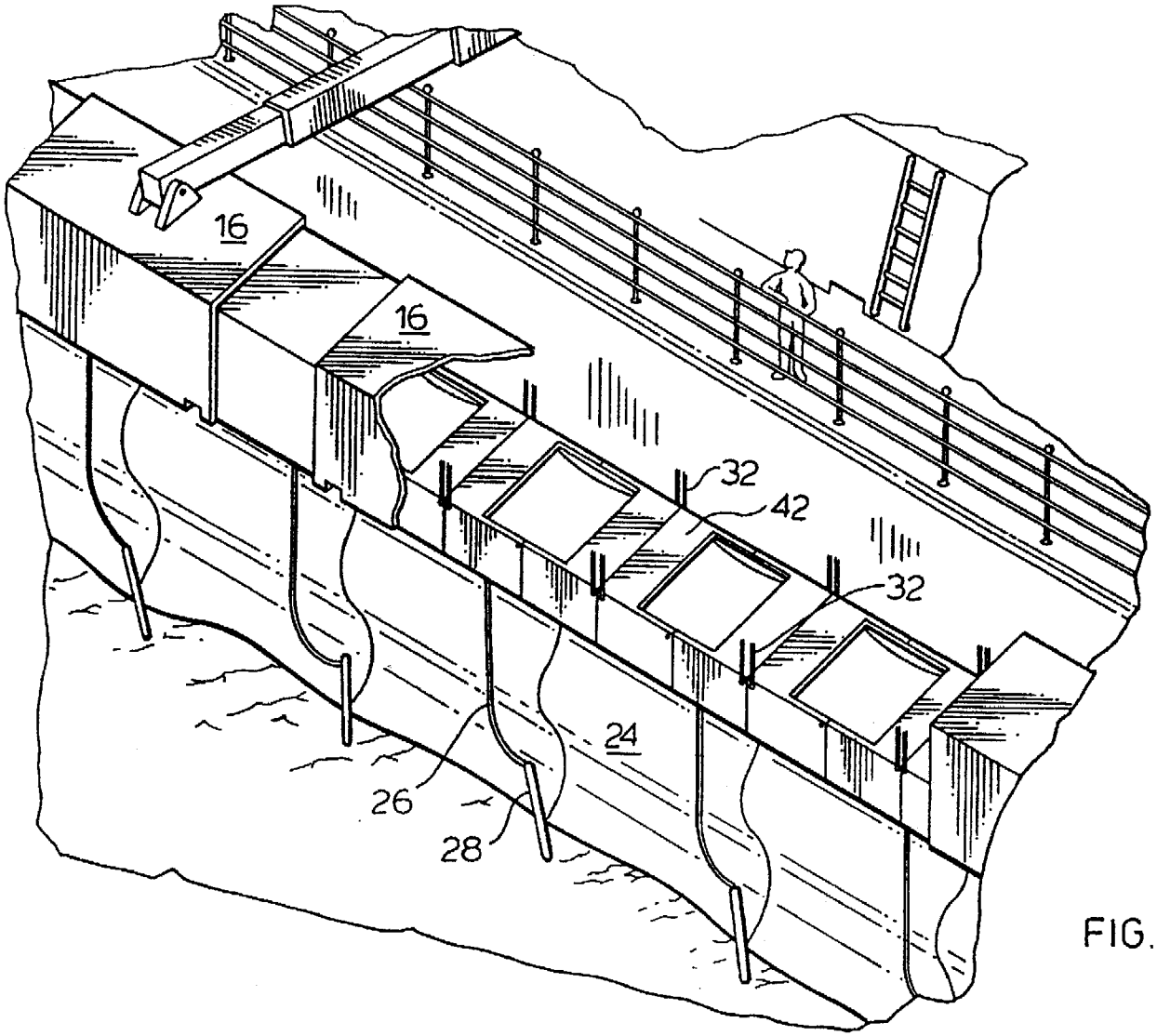
FIG. 16 illustrates the containment apparatus in the process of deployment.

In FIG. 16 the system is illustrated deployed outboard from the rail or hull of the vessel and the canisters 16 are fully separated to extend the curtain to its full peripheral length and the folding assemblies 42 are pivoted to the horizontal position at 90 degrees to the stored position illustrated in FIG. 14, and the curtain 24 has been partially lowered from the containers and folding assembly to the water level. The cables 26 which control the curtain, and the weights 28 are also illustrated, as are the cables 32 which control the folding assembly.

When it is desired to retract the containment system, the cables 26 are retracted to fold the curtain and lift it up into the folding assemblies 42 which are then returned to the vertical position, as illustrated in FIG. 14, so as to create the folds necessary to shorten the peripheral dimension of the system, and the entire combination can be retracted into the container 16 which can be pulled back onboard or into the hold of the vessel.

As previously mentioned, the folding assemblies 42 may be constructed of a material of sufficiently light weight and volume so as to constitute a flotation system at the top end of the curtain. This would allow the curtain to be dropped to its maximum depth in the water while the flotation system holds the top of the curtain at or above the waterline so that the spill can be contained but access to the surface of the spill for fire fighters may be achieved.

Figure 17:
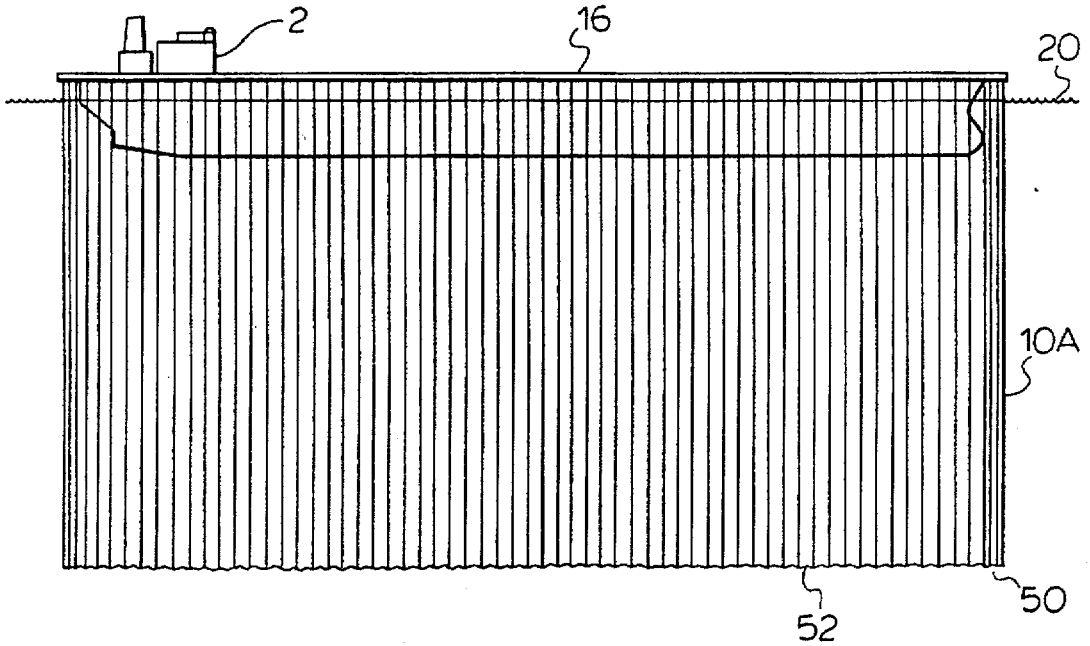
FIG. 17 illustrates the containment curtain fully deployed at substantial depth.
Figure 18:
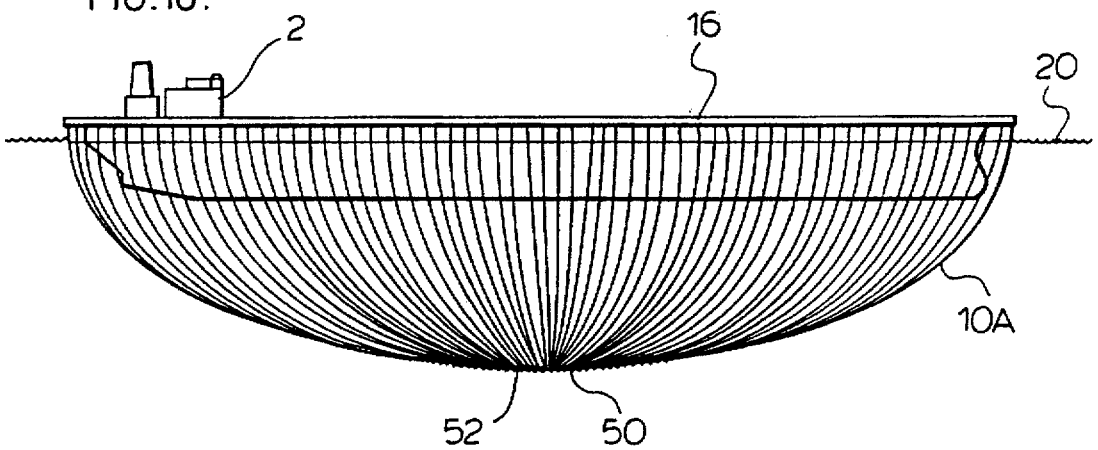
FIG. 18 shows the curtain in FIG. 17 closed at the bottom.

In FIG. 17 a containment curtain 10*a* of modified design is illustrated similar to that shown in FIG. 3 except that the curtain has a substantial vertical depth and the bottom edge 50 is connected to a cord or cable 52 at intervals. This modified design allows the bottom end of the curtain to be closed by drawing tight on the cable 52 to gather the bottom or hem of the curtain as shown in FIG. 18. This arrangement would allow the system to be used in situations where certain oils of heavy density show a tendency for particles of oil to sink under certain conditions, especially in cold water.

Thus, by means of the system as illustrated in the preferred embodiment, an environmental safety device may be installed on ships or barges to contain harmful cargoes in a compact and orderly manner, protected from damage by collision or impact with a wharf, out of the way for workers and equipment near the rail, and ready for deployment wherever the vessel may encounter difficulty or a spill is created.

When needed, the system may be deployed by releasing the canister locks, raising the canister by means of the deployment mechanism and the articulated arms to suspend the canisters around the vessel above the water, and the cable guides may be released to allow the curtain to hang down into a substantial depth of water so that any cargo leaking from the hold can be contained between the curtain and the hull of the ship, regardless of whether the ship is aground or afloat.

Furthermore, the substantial vertical dimension will prevent leakage of the cargo beneath or above the curtain, and the fact that it is deployed at a distance from the hull, will provide sufficient area for collection of the volume of material which may have escaped from the hold.

It will, of course, be realized that numerous variations and modifications of the illustrated embodiment may be employed without departing from the inventive concept herein.

The embodiments of the invention in which an exclusive property or privilege is claimed are defined as follows:

1. A spill containment system for vessels having a hull and a deck joined together to define a rail, comprising:

a containment curtain movable between a deployed position in which the curtain extends horizontally continuously around said vessel and hangs to extend vertically from a height above the waterline to a depth below the waterline and a stored position in which the curtain is in a folded configuration on said vessel;

a series of canisters capable of receiving the containment curtain in its folded configuration therein, said canisters located in the stored position within the hull of said vessel;

cable guide means associated with said curtain for raising said curtain from a deployed position to a folded configuration and for lowering said curtain from a folded configuration to a deployed position to hang vertically;

a deployment mechanism having a movable arm connected to said canisters and operable to move said canisters containing said folded curtain from a storage position inboard of the hull of said vessel to a deployed position outboard of the hull of said vessel.

2. A spill containment system as claimed in claim 1, in which said canisters containing said curtain are stored on the deck of said vessel at a position spaced inboard from the rail of said vessel so as to be protected from impact in the event of a collision with said vessel.

3. A spill containment system as claimed in 2, in which said system includes a wave barrier positioned outboard of said canisters to protect said canisters from wave action.

4. A spill containment system as claimed in claim 1 in which said canisters containing said curtain are stored below deck and spaced inboard from said rail of said vessel so as to be protected from impact in the event of a collision with said vessel.

5. A spill containment system as claimed in claim 1, in which said curtain is folded in horizontal layers for containment within said canisters.

6. A spill containment system as claimed in claim 5, in which said curtain is folded in an undulating pattern to reduce the circumferential dimension for storage.

7. A spill containment system as claimed in claim 1, in which said lower edge of said curtain has means whereby said lower edge may be gathered to form an enclosure beneath said vessel.

8. A spill containment system as claimed in claim 1, in which said arm of said deployment mechanism is reversibly extendible to move said canisters from the storage position within the hull to a deployed position outboard of the hull in which said curtain is spaced away from said hull.

* * * * *